US007315230B2

(12) United States Patent
Hoffman

(10) Patent No.: US 7,315,230 B2
(45) Date of Patent: Jan. 1, 2008

(54) ADJUSTABLE SOLENOID

(75) Inventor: Lawrence Andrew Hoffman, Portland, OR (US)

(73) Assignee: The Hoffman Group, LLC, Portland, OR (US)

( * ) Notice: Subject to any disclaimer, the term of this patent is extended or adjusted under 35 U.S.C. 154(b) by 307 days.

(21) Appl. No.: 10/922,390

(22) Filed: Aug. 19, 2004

(65) Prior Publication Data

US 2006/0038645 A1 Feb. 23, 2006

(51) Int. Cl.
*H01F 3/00* (2006.01)
*H01F 7/08* (2006.01)

(52) U.S. Cl. ..... 335/255; 335/261; 335/262; 335/263; 335/270; 335/273; 335/274; 335/279; 335/281

(58) Field of Classification Search ..... 335/255, 335/261–264, 270, 273, 274, 279, 281
See application file for complete search history.

(56) References Cited

U.S. PATENT DOCUMENTS 2,262,550 A * 11/1941 Hunter ..... 72/12.5
2,419,333 A * 4/1947 Christiansen ..... 335/263
4,839,620 A * 6/1989 Yagi ..... 335/219

* cited by examiner

*Primary Examiner*—Ramon M. Barrera
(74) *Attorney, Agent, or Firm*—Paul J. Fordenbacher, Esq.; Silicon Forest Patent Group, LLC

(57) ABSTRACT

Embodiments of the present invention provide solenoid plungers, solenoid actuators, and solenoid-actuated mechanisms, that provide for an adjustable stroke, adjustable rated force, and adjustable plunger extension that overcome the problems and issues associated with non-adjustable solenoid actuators. In accordance with an embodiment of the present invention, an adjustable solenoid plunger is provided that comprises a stem and an armature including an axial armature bore. The stem engages the armature bore and is adapted for advancement of the armature along at least a portion of the stem.

14 Claims, 8 Drawing Sheets

ADJUSTABLE SOLENOID

FIELD OF THE INVENTION

This invention generally relates to electromagnetic devices, and more particularly, to solenoid actuators for use in powering mechanisms.

BACKGROUND

Power-driven components are becoming commonplace in motor vehicles as customers demand comfort and convenience. Power-actuated door latches and locks, hood releases, trunk openers, fuel-door openers, and hatches, for example, are either standard or optional equipment on many of today's cars and trucks. Customers looking to enhance their existing, non-powered equipment commonly turn to aftermarket components for conversion to power-driven equipment.

FIG. 1 is a perspective view of a known pull-type solenoid actuator 10, such as the type used to pull a cable or a latch or open a valve. The solenoid actuator 10 comprises a solenoid 11 and a plunger 13. The solenoid 11 comprises a coil 14, a housing 12, and a spring 15. The coil 14 is a long insulated wire wound with a helical pattern around a bobbin (not shown) defining a plunger bore 16. The wire is coupled to a voltage source by way of electrical conductors 17. The plunger 13 comprises an armature 18 and a stem 19. The stem 19 is adapted to be coupled to an external mechanism (not shown). The armature 18 comprises a magnetically-conductive material, such as, but not limited to, iron.

The solenoid actuator 10 coverts electrical energy to linear motion. Electrical activation of the solenoid 11 causes magnetic forces to act on the armature 18 to linearly translate the plunger 13 into the plunger bore 16 from a first position to a second position. When electrical energy is removed from the solenoid 11, the plunger 13 returns to the first position by the urging of the spring 15.

The linear motion of the plunger 13 can be used to power mechanisms that are normally manually operated from a first position to a second position. Examples of these mechanisms include the opening/closing and locking/unlocking of door latches, hood releases, trunk openers, fuel-door openers, and hatches.

The plungers 13 on known solenoid actuators 10 have a preset stroke that is not adjustable. The stroke is the distance that the plunger 13 moves between the un-energized and energized state. When energized, the plunger 13 is pulled into the bore 16 a predetermined distance defining the stroke.

The plungers 13 on known solenoid actuators 10 also have a preset plunger extension that is not adjustable. The plunger extension is the distance that the plunger 13 extends from an end of the solenoid 11.

Solenoid manufacturers must supply a plurality of solenoid actuator models with different strokes and different extensions to accommodate the various applications for which they are used. A starter motor, for example, requires a stroke of a particular distance, whereas a latching mechanism requires a stroke usually of a difference distance. This creates a great burden on the manufacturers and suppliers as a large inventory must be maintained to accommodate all of the solenoids of various strokes.

Solenoids also are specified with a rated force. The rated force is the amount of load that the solenoid actuator 10 is capable of providing the plunger 13 at the start of the stroke when energized. For example, the force required by a solenoid actuator 10 to engage a starter motor to an engine flywheel might be different than the force required to operate a door lock. The rated force is determined, in part, by the number of turns in the coil 14, the size of the plunger 13, the position of the plunger 13 relative to the coil 14, and the amount of current supplied to the coil 14. The number of turns in the coil 14, the size of the plunger 13, and the position of the plunger 13 relative to the coil 14, are constant for a given solenoid actuator 10, and the amount of current supplied to the coil 14 is typically a constant. Therefore, as in the case of stroke, the rated force is not adjustable.

Solenoid manufacturers must supply a plurality of solenoid models each with different rated force to accommodate the various applications for which they are used. This also creates a burden on the manufacturers and suppliers as a large inventory must be maintained to accommodate all of the solenoids of various rated forces. This burden is compounded greatly considering the combined specification of stroke and rated force. Economics of production and supply requires that a compromise be made which commonly results in the installer using a solenoid actuator that does not have an ideal specification for a particular application.

What is needed in the art is a solenoid actuator that has an adjustable stroke, adjustable rated force, and adjustable extension. This would help to alleviate the burden of manufacture and inventory as an adjustable solenoid actuator will be able to provide the stroke, rated force, and extension of multiple solenoid actuator models. Further, an adjustable solenoid actuator may be able to provide the stroke, rated force, and extension not currently being manufactured due to economic realities. An adjustable solenoid actuator would be especially advantageous for the automotive after-market parts industry as the adjustability would provide the installer with flexibility in installation on pre-existing components.

SUMMARY

Embodiments of the present invention provide solenoid plungers, solenoid actuators, and solenoid-actuated mechanisms, that provide for an adjustable stroke, adjustable rated force, and adjustable plunger extension that overcome the problems and issues associated with non-adjustable solenoid actuators.

In accordance with an embodiment of the present invention, an adjustable solenoid plunger is provided that comprises a stem and an armature including an axial armature bore. The stem engages the armature bore and is adapted for advancement of the armature along at least a portion of the stem.

In another embodiment, the armature bore comprises threads. The stem is threadably engaged with the armature bore.

In another embodiment, the plunger comprises a plunger first end and a plunger second end and the stem comprises a head, a tail opposite the head, and a body therebetween. The body comprises an elongated member having a stem threaded portion. The tail includes a tail retention element. The armature comprises a cylindrical member adapted for sliding reception within the plunger bore. The armature comprises an armature first end and an armature second end opposite the armature first end. The armature comprises a material highly permeable to a magnetic field.

In another embodiment, the armature second end comprises an armature seat having complementary geometry with the back stop seat.

In another embodiment, the threaded portion of the stem is threadably engaged with the armature bore with the head extending from the armature first end and the tail extending from the armature second end. The armature is adapted to be threadably advanced on the stem towards or away from the head. The tail is disposed through the armature bore extending from the armature second end. The tail is adapted for extending into and through the armature bore without engagement therewith.

In another embodiment, the stem includes a tail, at least a portion of which includes a tail threaded portion. The plunger further comprises a fastener adapted for threadable engagement with the tail threaded portion. The location of the fastener on the tail threaded portion is adjustable.

In another embodiment, the stem comprises a head, a tail opposite the head, and a body therebetween. The head comprises at least one plunger coupler element. The tail comprises an elongated member having a tail threaded portion. The body includes a stem retention element.

In another embodiment, the stem comprises a head and a tail opposite the head. The head comprises at least one plunger coupler element. The tail comprises an elongated member having a tail threaded portion. The plunger further comprises a fastener adapted for threadable engagement on the tail threaded portion. The location of the fastener on the tail threaded portion is adjustable for a particular purpose.

In accordance with other embodiments of the present invention, an adjustable solenoid actuator comprises a solenoid defining a plunger bore and a plunger comprising a stem and an armature. The armature includes an axial armature bore. The stem is engaged with the armature bore and adapted for advancement of the armature along at least a portion of the stem.

In another embodiment, the armature bore comprises threads. The stem is threadably engaged with the armature bore and adapted for advancement of the armature along at least a portion of the stem.

In another embodiment, the plunger comprises a plunger first end and a plunger second end. The stem comprises a head, a tail opposite the head, and a body therebetween. The body comprises an elongated member having a stem threaded portion, the tail including a tail retention element. The armature comprises a cylindrical member adapted for sliding reception within the plunger bore. The armature comprises an armature first end and an armature second end opposite the armature first end. The armature comprises a material highly permeable to a magnetic field.

In another embodiment, the solenoid comprises a coil including a long insulated wire wound with a helical pattern defining the plunger bore about an axis, a housing defining a cavity adapted to house the coil, the housing including a housing first end and a housing second end opposite the housing first end, the housing first end comprising an inwardly extending coil retention flange defining a housing aperture substantially coaxial with the plunger bore, a back stop disposed in and adapted to enclose the housing second end and retain the coil within the housing, the back stop comprising a back stop outer flange, a back stop inner flange, and a back stop seat, the back stop outer flange adapted to be slidingly received within the cavity and couple with the housing second end, the back stop inner flange defining a back stop aperture substantially coaxial with the plunger bore, the back stop seat adapted to extend into the plunger bore, and a spring comprising a wire formed into a helical configuration, wherein the armature second end further comprises a spring seat adjacent the armature bore. The spring seat is adapted to accept an end of the spring. The plunger second end extends into the plunger bore through the housing aperture. The plunger first end extends out of the plunger bore through the housing aperture. The spring is disposed within the plunger bore between the back stop inner flange and the spring seat of the armature. The back stop is adapted to prevent the armature from passing through the housing second end. The back stop is adapted to allow the tail to pass through the housing second end. The spring is adapted to provide an urging bias acting to urge the armature away from the back stop. The plunger is disposed within the plunger bore with at least a portion of the tail including the tail retention element extending from the plunger bore and through the back stop aperture. The plunger is retained in engagement with the solenoid by the engagement of a fastener coupled to the tail retention element. The fastener is adapted to capture the back stop inner flange between the armature and the fastener.

In another embodiment, the armature second end comprises an armature seat having complementary geometry with the back stop seat.

In another embodiment, the spring seat adapted to contain the spring when compressed by the armature and the back stop to allow for abutment of the backstop seat and the armature seat.

In another embodiment, the stem threaded portion of the stem is threadably engaged with the armature bore with the head extending from the armature first end and the tail extending from the armature second end. The armature is adapted to be threadably advanced on the stem towards or away from the head. The tail is disposed through the armature bore extending from the armature second end. The tail is adapted for extending into and through the armature bore without engagement therewith.

In another embodiment, the plunger bore comprises an axially-aligned keyway and the armature comprises a mating key complimentary to the keyway. The cooperation of the keyway and the key is adapted for axial motion of the plunger while restricting rotation of the armature.

In another embodiment, the tail retention element comprises a tail threaded portion. The fastener is adapted for threadable engagement with the tail threaded portion. The location of the fastener on the tail threaded portion is adjustable. The head extends from the housing aperture a predetermined distance defined by location of the fastener along the tail threaded portion.

In another embodiment, the stem comprises a head, a tail opposite the head, and a body therebetween. The head comprises at least one plunger coupler element. The tail comprises an elongated member having a tail threaded portion. The body includes a stem retention element. The solenoid comprises a coil, a housing, a helical spring, and a backstop. The coil includes a long insulated wire wound with a helical pattern defining the plunger bore about an axis. The housing defines a cavity adapted to house the coil, the housing including a housing first end and a housing second end opposite the housing first end, the housing first end comprising an inwardly extending coil retention flange defining a housing aperture substantially coaxial with the plunger bore, a back stop disposed in and adapted to enclose the housing second end and retain the coil within the housing. The back stop comprises a back stop outer flange, a back stop inner flange, and a back stop seat, the back stop outer flange adapted to be slidingly received within the cavity and couple with the housing second end. The back stop inner flange defines a back stop aperture substantially coaxial with the plunger bore. The back stop seat is adapted to extend into the plunger bore. The armature second end further comprises a spring seat adjacent the armature bore. The spring seat is adapted to accept an end of the spring, the spring being disposed within the plunger bore between the back stop inner flange and the spring seat. The tail is disposed through the back stop aperture and through the spring, and threadably engaged with the armature bore of the armature. The tail extends from the armature first end. The armature is at least partially disposed within the plunger bore. The head extends from the plunger bore through the back stop aperture a predetermined distance defined by the location of the stem retention element along the stem. At least a portion of the body including the stem retention element extends from the plunger bore and through the back stop aperture defined by the back stop inner flange. The back stop aperture is adapted to receive the tail and body therethrough. The plunger is engaged with the solenoid by the engagement of a fastener coupled to the body about the stem retention element, the fastener adapted to capture the back stop inner flange between the armature and the fastener.

In another embodiment, the tail retention element comprises a tail threaded portion and the fastener is adapted for threadable engagement with the tail threaded portion. The location of the fastener on the tail threaded portion is adjustable. The head extends from the housing aperture a predetermined distance defined by location of the fastener along the tail threaded portion.

In accordance with other embodiments of the present invention, a solenoid-actuated latching mechanism comprises a latching mechanism comprising a lever, a pivot, a lever head, a restoring spring, a locking notch device, and a cable. The lever is adapted to pivot about the pivot. The restoring spring is coupled to the lever in urging engagement. The leaver head is adapted for engagement with the locking notch device. The cable is coupled to the lever. The adjustable solenoid actuator comprises a solenoid defining a plunger bore and a plunger comprising a stem and an armature. The armature includes an axial armature bore. The stem is engaged with the armature bore and adapted for advancement of the armature along at least a portion of the stem. The plunger comprises a head. The cable is coupled to the head. The plunger is adapted to pull the cable to disengage the lever head from the locking-notch device. The return spring is adapted to urge the lever head into engagement with the locking-notch device.

In accordance with other embodiments of the present invention, a method for adjusting the stroke and force of a plunger of a solenoid actuator is provided, comprising providing a solenoid actuator comprising a solenoid defining a plunger bore, and a plunger comprising a stem and an armature, the armature including an axial armature bore, the stem engaged with the armature bore and adapted for advancement of the armature along at least a portion of the stem, at least a portion of the armature disposed within the plunger bore, and changing the position of the armature on the stem while retaining the relative position of the stem with respect to the bore.

In another embodiment, changing the position of the armature on the stem retaining the relative position of the stem with respect to the bore comprises rotating the stem with respect to the armature wherein the stem and armature bore comprise threads and are in threadable engagement therewith.

In another embodiment, a method for adjusting the extension of a plunger from a plunger bore of a solenoid actuator is provided, comprising providing a solenoid actuator comprising a solenoid defining a plunger bore, and a plunger comprising a stem and an armature, the armature including an axial armature bore, the stem engaged with the armature bore and adapted for advancement of the armature along at least a portion of the stem, at least a portion of the stem extending from the plunger bore, at least a portion of the armature disposed within the plunger bore, and changing the position of the armature on the stem retaining the relative position of the armature with respect to the bore.

In another embodiment, changing the position of the armature on the stem retaining the relative position of the armature with respect to the bore comprises rotating of the stem with respect to the armature wherein the stem and armature bore comprise threads and are in threadable engagement therewith.

BRIEF DESCRIPTION OF THE FIGURES

FIG. 7 is a side cross-sectional view of a push-type adjustable solenoid actuator in an un-energized state, in accordance with another embodiment of the present invention.

DESCRIPTION

In the following detailed description, reference is made to the accompanying drawings which form a part hereof wherein like numerals designate like parts throughout, and in which is shown by way of illustration specific embodiments in which the invention may be practiced. Embodiments of the present invention provide solenoid plungers and solenoid actuators that provide for an adjustable stroke, adjustable rated force, and adjustable plunger extension that overcome the problems and issues associated with non-adjustable solenoid actuators. It is to be understood that other embodiments may be utilized and structural or logical changes may be made without departing from the scope of the present invention. Therefore, the following detailed description is not to be taken in a limiting sense, and the scope of the present invention is defined by the appended claims and their equivalents.

Figure 1:
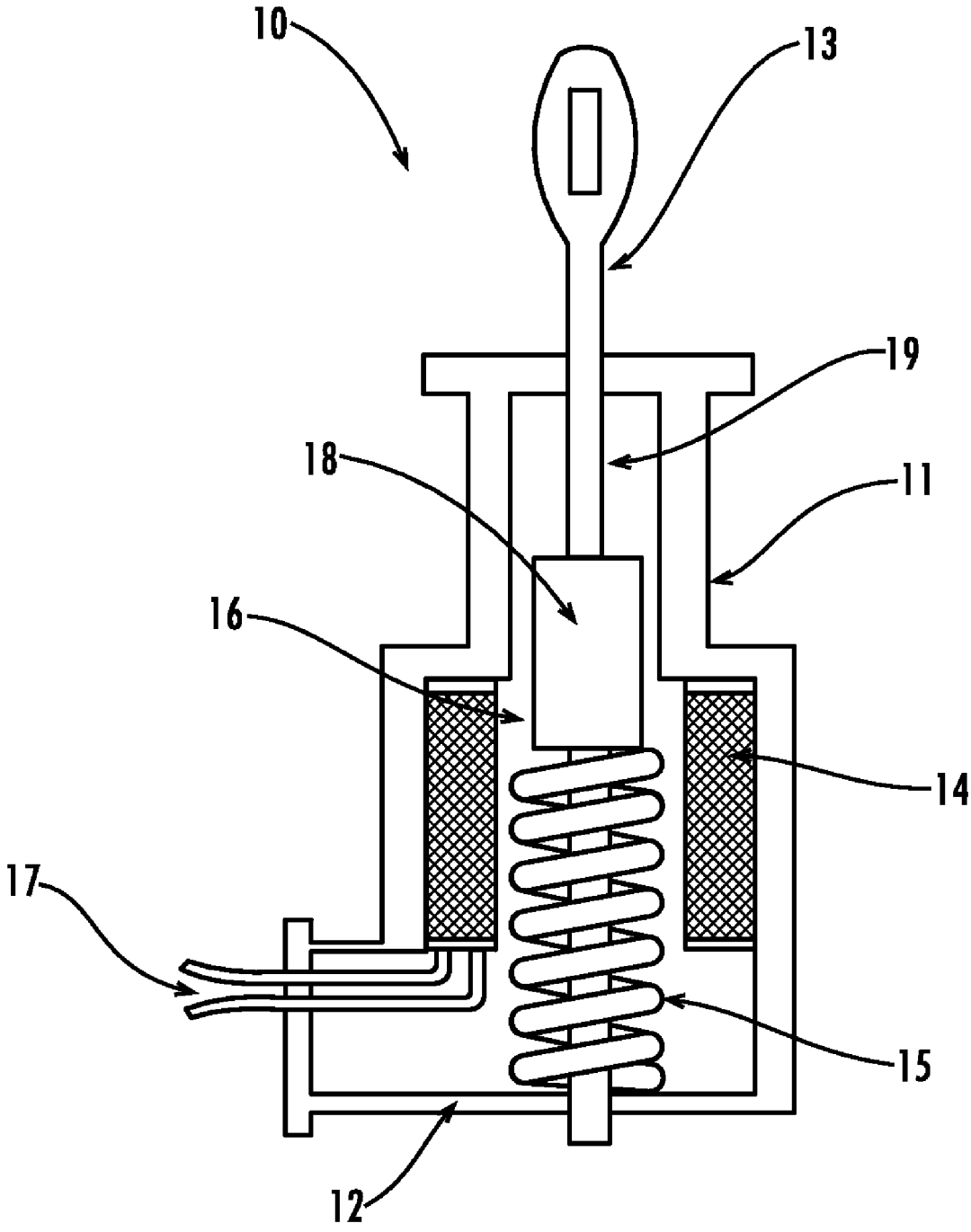
(Prior Art) Fig. 1
FIG. 1 is a side cross-sectional view of a common solenoid actuator known in the art.
Figure 2:
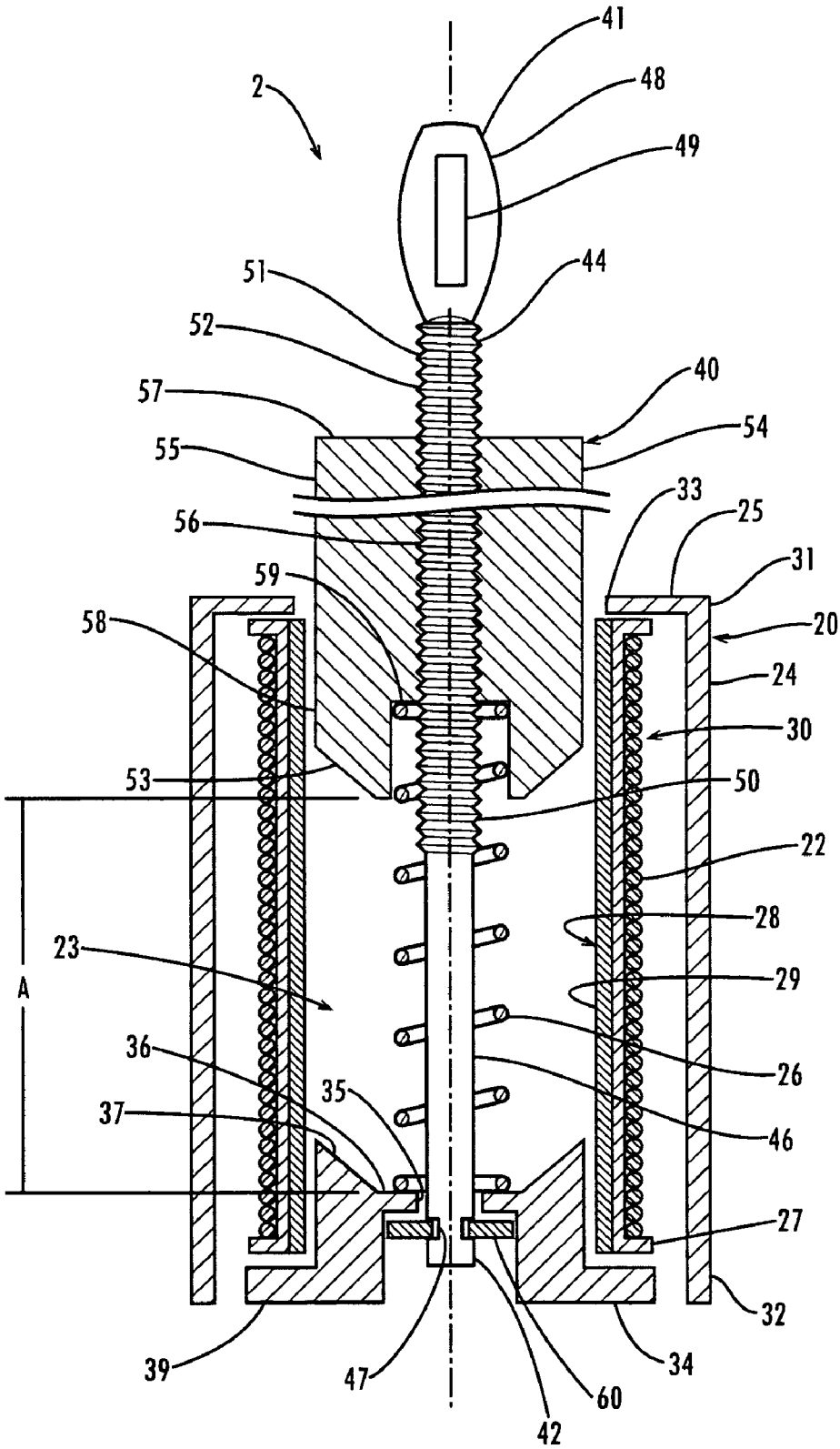
FIG. 2 is a side cross-sectional view of a solenoid actuator in accordance with an embodiment of the present invention.

FIG. 2 is a side cross-sectional view of a solenoid actuator 2 in accordance with an embodiment of the present invention. The solenoid actuator 2 comprises a solenoid 20 and a plunger 40. The solenoid 20 comprises a coil 22, a housing 24, a back stop 34, and a spring 26. The coil 22 is a long insulated wire wound with a helical pattern around a bobbin 27 defining a plunger bore 28. The wire is coupled to a voltage source by way of electrical contacts (not shown).

The bobbin 27 comprises a non-magnet material, such as, but not limited to, glass-filled nylon. As the plunger bore 28 is subject to the sliding engagement of the plunger 40, a wear and friction-reduction means may be employed, such as, but not limited to, a coating or liner. By way of example, the plunger bore 28 in the embodiment of FIG. 2 includes a bore liner 29 comprising a low friction non-magnetic material, such as, but not limited to, a brass sleeve, to reduce friction between the plunger bore 28 and the plunger 40.

The housing 24 is generally cylindrical and defines a cavity 30 adapted to house the coil 22. The housing 24 includes a housing first end 31 and a housing second end 32 opposite the housing first end 31. The housing first end 31 comprises an inwardly extending coil retention flange 25 that defines an axial housing aperture 33 having substantiality the same diameter as the inner diameter of the bore liner 29. In other embodiments, the inwardly extending coil retention flange 25 is provided by a disk-shaped plug having a central aperture and an outer diameter adapted to slide within the cavity and coupled to the housing 24, by way of, such as, but not limited to, a crimped joint around an edge of the housing first end 31 capturing the plug at the housing first end 31.

The housing 24 comprises a material having a high magnetic permeability, such as, but not limited to, magnetic steel. The housing 24 serves to house the coil 22 as well as provide a magnetic flux path for the flux generated by the coil 22 when electrically energized.

The back stop 34 is a plug-like member disposed in and adapted to enclose the housing second end 32, retaining the coil 22 within the housing 24. The back stop 34 comprises a back stop outer flange 39, a back stop inner flange 36, and a back stop seat 37. The back stop outer flange 39 has an outer diameter adapted to slide within the cavity and couple with the housing 24, by way of, such as, but not limited to, a crimped joint around an edge of the housing second end 32 capturing the back stop 34 at the housing second end 32. The back stop inner flange 36 defines an axial back stop aperture 35, the purpose of which is discussed below.

The back stop seat 37 is adapted to extend into the plunger bore 28 and abut a portion of the plunger 40 to limit the stroke of the plunger 40 when the solenoid 20 is energized, which will be discussed below.

The back stop 34 comprises a material having a high magnetic permeability, such as, but not limited to, magnetic steel. The back stop 34 serves to contain the coil 22 as well as provide a magnetic flux path for the flux generated by the coil 22 when electrically energized.

The spring 26 is a stiff wire formed into a helical configuration suitable for a particular purpose. The length of the spring 26 is predetermined for a particular purpose. In the embodiment of FIG. 2, the spring 26 has a length such that the plunger 40 is suitably positioned within the plunger bore 28. The outer diameter of the spring 26 is adapted to be freely slidingly received within the plunger bore 28 and the inner diameter of the spring 26 is adapted to freely slidingly receive a portion of the plunger 40 as described below.

The plunger 40 comprises a stem 44 and an armature 54. The plunger 40 includes a plunger first end 41 and a plunger second end 42. The stem 44 comprises a head 48, a tail 46 opposite the head 48, and a body 50 therebetween. The head 48 comprises at least one plunger coupler element 49. The plunger coupler element 49 is adapted to couple with a mechanism to be activated by the solenoid actuator 2, such as, but not limited to, a cable or latch hook. It is understood that the plunger coupler element 49 can take many forms, such as, but not limited to, an eyelet, which is an aperture, or through-hole, a hook, a slot, and a threaded bore, suitable for a particular purpose.

The body 50 is an elongated member having a stem threaded portion 52 which includes helical threads 51. The tail 46 includes a tail retention element 47 which will be discussed below.

The armature 54 is a cylindrical member having an armature outer surface 55 adapted to be slidingly received within the plunger bore 28. The armature 54 includes an axial armature bore 56 adapted for threadable engagement with the stem threaded portion 52 of the body 50 of the stem 44. The armature 54 comprises an armature first end 57 and an armature second end 58 opposite the armature first end 57. The armature 54 comprises a material highly permeable to a magnetic field, such as, but not limited to, iron. The armature 54 provides a magnetic flux path for the flux generated by the coil 22 when electrically energized.

In consideration of friction between the armature outer surface 55 and the plunger bore 28, in accordance with other embodiments of the present invention, the armature outer surface 55 comprises a friction-reducing coating (not shown), such as, but not limited to, nickel plating.

The armature second end 58 comprises an armature seat 53. The armature seat 53 comprises complementary geometry with the back stop seat 37, suitable for a particular purpose. In the embodiment shown in FIG. 2, the back stop seat 37 comprises an approximate 60 degree concave cone and the armature seat 53 comprises a complementary approximate 60 degree convex cone. In other embodiments in accordance with the present invention, other complementary geometric configurations include, but are not limited to, flat and rounded concave/convex, suitable for a particular purpose. In general, a flat armature seat 53 and back stop seat 37 is usually chosen to provide a relatively strong holding force with a relatively short stroke. A conical armature seat 53 and back stop seat 37 is usually chosen to provide a lower holding force with a relatively long stroke.

The armature second end 58 further comprises a spring seat 59 adjacent the armature bore 56. The spring seat 59 is adapted to accept an end of the spring 26, and contain the spring 26 when compressed by the armature 54 and the back stop 34 to allow for abutment of the backstop seat 37 and the armature seat 53, as further discussed below.

The stem threaded portion 52 of the stem 44 is threadably engaged with the armature bore 56 of the armature 54 with the head 48 extending from the armature first end 57 and the tail 46 extending from the armature second end 58. The stem threaded portion 52 is of sufficient length relative to the armature bore 56 such that the armature 54 may be threadably advanced along the body 50 for a predetermined amount of travel. The armature 54 is adapted to be threadably advanced on the stem 44 towards or away from the head 48.

During assembly of the plunger 40, the tail 46 is passed through the armature bore 56 of the armature 54 from the armature first end 57 to extend from the armature second end 58. The diameter of the tail 46 is adapted to allow for extending into and through the armature bore 56 without engagement therewith. The stem threaded portion 52 is threadably engaged with the armature bore 56.

The plunger 40 is disposed within the solenoid 20 such that the plunger second end 42 extends into the plunger bore 28 through the housing aperture 33 and towards the back stop 34, and the plunger first end 41 extends out of the plunger bore 28 through the housing aperture 33. The spring 26 is disposed within the plunger bore 28 between the back stop inner flange 36 and the spring seat 59 of the armature 54. The back stop 34 is adapted to prevent the armature 54 from passing through the housing second end 32 of the housing 24 but allow the tail 46 to freely pass therethrough. The spring 26 is adapted to provide an urging bias that urges the armature 54 away from the back stop 34.

The plunger 40 is disposed within the plunger bore 28 such that at least a portion of the tail 46 including the tail retention element 47 extends from the plunger bore 28 and through the back stop aperture 35 defined by the back stop inner flange 36. The back stop aperture 35 is adapted to freely receive the tail 46 therethrough. The plunger 40 is held within the plunger bore 28 by the engagement of a fastener 60 coupled to the tail 46 about the tail retention element 47. The fastener 60 has a dimension larger than the dimension of the back stop aperture 35. The fastener 60 is adapted to capture the back stop inner flange 36 between the armature 54 and the fastener 60.

As shown in FIG. 2, by way of example, the tail retention element 47 comprises a circular notch in the tail 46 into which a fastener 60 comprising a C-clip is disposed. The engagement of the fastener 60 in cooperative engagement with the armature 54, the spring 26, and the back stop 34 effectively retaining engagement of the plunger 40 with the solenoid 20 while allowing the plunger 40 to linearly travel in an axial direction in sliding engagement within the plunger bore 28 for a predetermined stroke.

It is understood that one skilled in the art would appreciate that the tail 46 can be adapted to retain engagement of the plunger 40 with the solenoid 20 by a great number of fastening means. Examples of fastening means include, but not limited to, a nut on a threaded tail, a spring clip, an enlargement of the dimension of the tail 46 beyond that of the back stop aperture 35 by stamping or bending, among others.

The extent of the linear movement of the plunger 40 within the plunger bore 28 is referred to as the stroke. The position of the armature 54 with respect to the back stop 34 when the solenoid is not energized is indicated as "A". The space between the armature seat 53 and back stop seat 37 is referred to as the air space 25.

Figure 3:
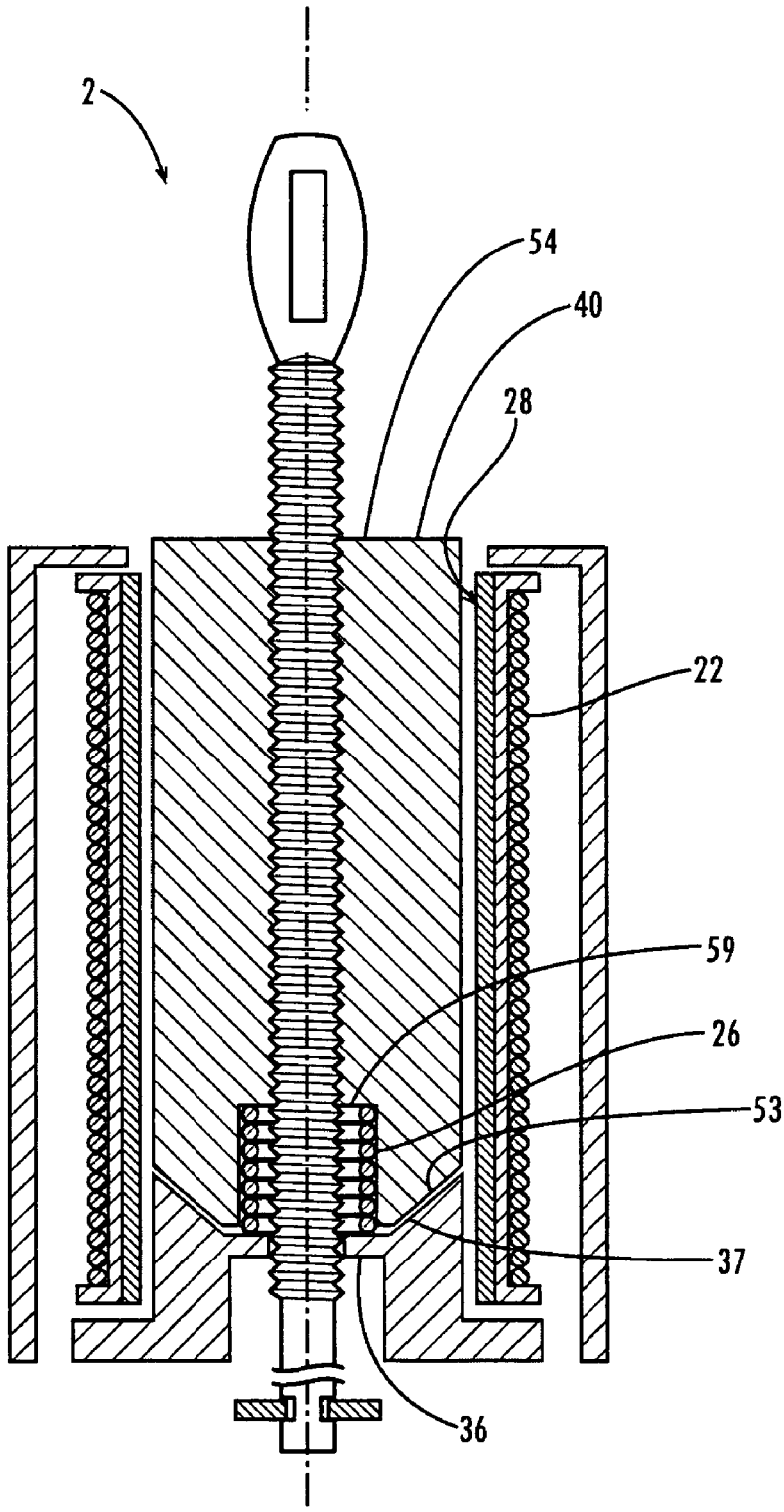
FIG. 3 is a side cross-sectional view of the solenoid actuator when electrically energized, in accordance with the embodiment of FIG. 2.

FIG. 3 is a side cross-sectional view of the solenoid actuator 2 when electrically energized, in accordance with the embodiment of FIG. 2. The magnetic flux created by the coil 22 causes the plunger 40 to be drawn into the plunger bore 28 at least partially overcoming the bias in the spring 26. The spring seat 59 of the armature 54 abuts the spring 26, compressing it between the spring seat 59 and the back stop inner flange 36, as the armature seat 53 and back stop seat 37 are brought proximate to each other and, in abutment in the case wherein the magnetic force is sufficient to overcome the spring bias.

Figure 4:
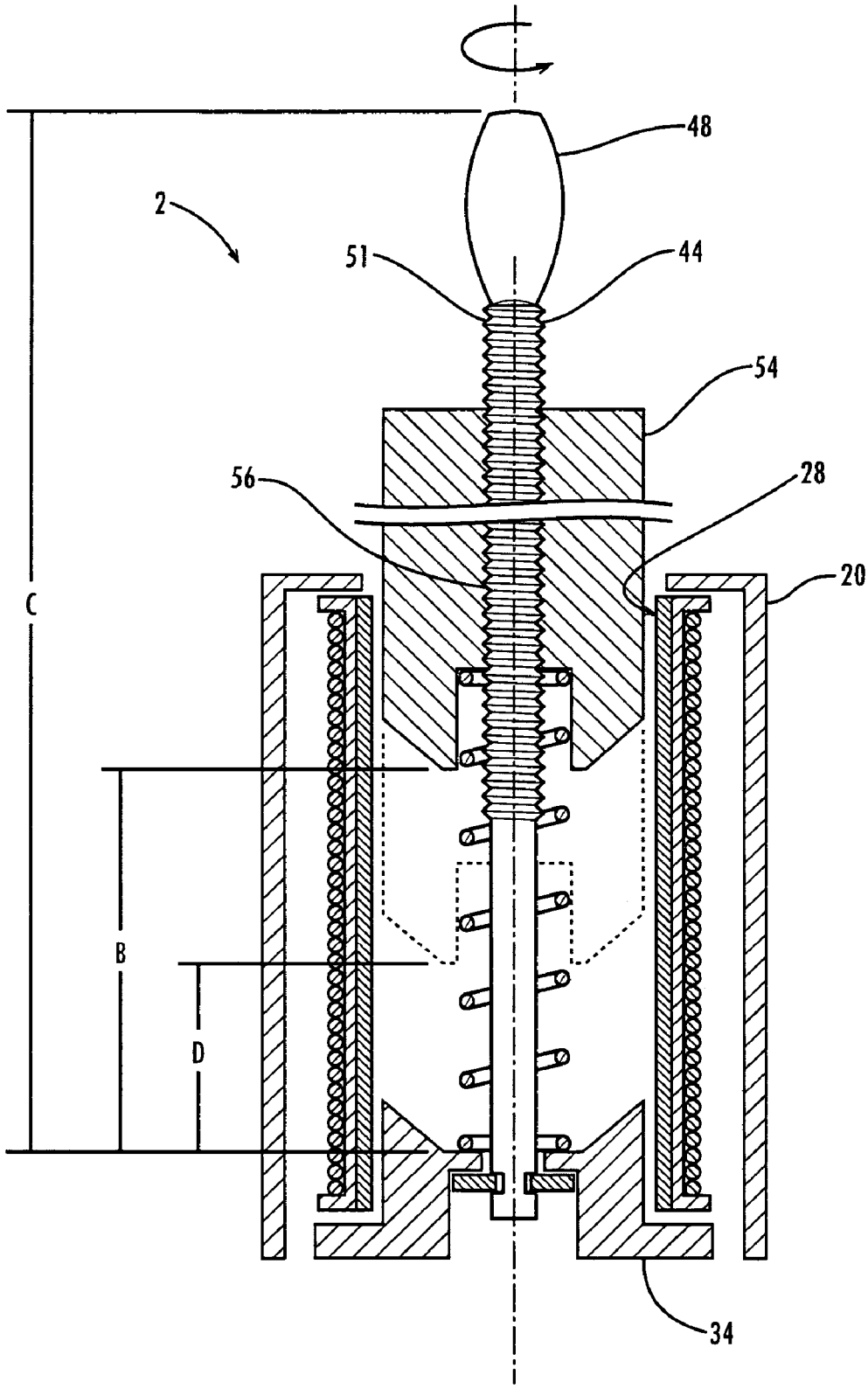
FIG. 4 is a side cross-sectional view of the solenoid actuator illustrating the result of adjusting of position of the armature within the plunger bore, and therefore adjusting of the stroke, in accordance with an embodiment of the present invention.

FIG. 4 is a side cross-sectional view of the solenoid actuator 2 illustrating the adjustability of position of the armature 54 within the plunger bore 28, and therefore the stroke, to suite a particular purpose. The solenoid actuator 2 is shown in an un-energized state. The armature 54 extends into the plunger bore 28 of the solenoid 20 such that the position of the armature 54 with respect to the back stop 34 is indicated as "B" with the position of the head 48 with respect to the back stop 34 is indicated as "C".

The stroke is adjusted or changed by changing the axial position of the armature 54 within the plunger bore 28 with respect to the back stop 34. The position of the armature 54 is changed by rotation of the stem 44 with respect to the armature 54. Depending on the configuration of the threads 51, a clock-wise or counter clock-wise rotation of the stem 44 within the armature bore 56, restraining the armature 54 from rotating, will advance the armature 54 either further into or out of the plunger bore 28.

Dotted lines indicate an outline of the armature 54 illustrating that the armature 54 has been adjusted to extend further into the plunger bore 28 of the solenoid 20 a predetermined distance; the position of the armature 54 with respect to the back stop 34 is indicated as "D". Note that the position of the head 48 with respect to the back stop 34 remains substantially the same, indicated as D, for this or any other position of the armature 54 about the stem 44.

The armature 54 can be restricted from rotating when the stem 44 is rotated by any number of means. For example, but not limited thereto, the engagement of the armature 54 and the plunger bore 28 can have sufficient friction to substantially restrict rotation of the armature 54, the armature 54 can be held with the installer's fingers while the stem 44 is turned, and by mechanical means.

In one embodiment in accordance with the present invention, the plunger bore 28 comprises an axially-aligned keyway while the armature 54 comprises a mating key. The cooperation of the keyway and the key allows for axial motion of the plunger 40 while restricting the rotation of the armature 54.

Embodiments in accordance with the present invention provide adjustable-stroke solenoid actuators 2, by way of having the ability to move the armature 54 with respect to the stem 44 providing a degree of adjustability with regards to the length of stroke. For the manufacturer or supplier, an adjustable-stroke solenoid actuator 2 can replace a number of fixed-stroke solenoids over a predetermined range of stroke-lengths reducing the burden of production and inventory. Further, the adjustable-stroke solenoid actuator 2 is able to provide the stroke that is between production models or not currently being manufactured due to economic realities.

The adjustable-stroke solenoid actuator 2 provided in accordance with embodiments of the present invention provides infinite adjustably over the predetermined range. This enables the user to adjust the stroke to more closely match the application for which it is being used; essentially providing a custom-stroke solenoid.

The rated force of a pulling-type solenoid actuator 2 is the initial load that the solenoid actuator 2 is capable of providing at the start of the stroke when energized under a specific set of conditions. These conditions include, but at not limited to, voltage, temperature, and duty cycle. The force rapidly increases as the stroke decreases. Referring to FIG. 2, for a solenoid actuator having no spring 26, the force is approximately inversely proportional to the square of the distance between the armature seat 53 and back stop seat 37. The addition of the spring 26, which provides a return bias to the plunger 40 when the solenoid actuator 2 is un-energized, will modify the load that the solenoid actuator 2 is capable of providing, dependent in part on the spring constant of the spring 26.

The rated force of the solenoid actuator 2, in accordance with embodiments of the present invention, is adjustable as a consequence of the ability to adjust the stroke. As the stroke is adjusted as provided above, the force on the plunger 40 is also adjusted. When the stroke is lengthened by moving the armature 54 distal from the back stop 34, the force on the plunger 40 will be reduced. As the armature 54 is adjusted proximate the back stop 34, shortening the stroke, the force on the plunger 40 will be increased.

Embodiments in accordance with the present invention provide adjustable force solenoid actuators 2, by way of having the ability to move the armature 54 with respect to the stem 44 providing a degree of adjustability with regards to the initial force. For the manufacturer or supplier, an adjustable force solenoid actuator 2 can replace a number of fixed-force solenoid actuators over a predetermined range of rated forces reducing the burden of production and inventory. Further, the adjustable-force solenoid actuator 2 is able to provide the force that is between production models or not currently being manufactured due to economic realities.

The adjustable-force solenoid actuator 2 provided in accordance with embodiments of the present invention provides infinite force adjustably over the predetermined range. This enables the user to adjust the force to more closely match the application for which it is being used; essentially providing a custom-force solenoid.

The embodiment of the solenoid actuator 2 provided above provides a pull-type adjustable solenoid actuator 2 having a number of adjustable configurations suitable for a particular purpose. The stroke, and therefore the force, can be adjusted providing a head 48 that remains in the same relative position regardless of the position of the armature 54 when the solenoid 20 is un-energized.

Figure 5:
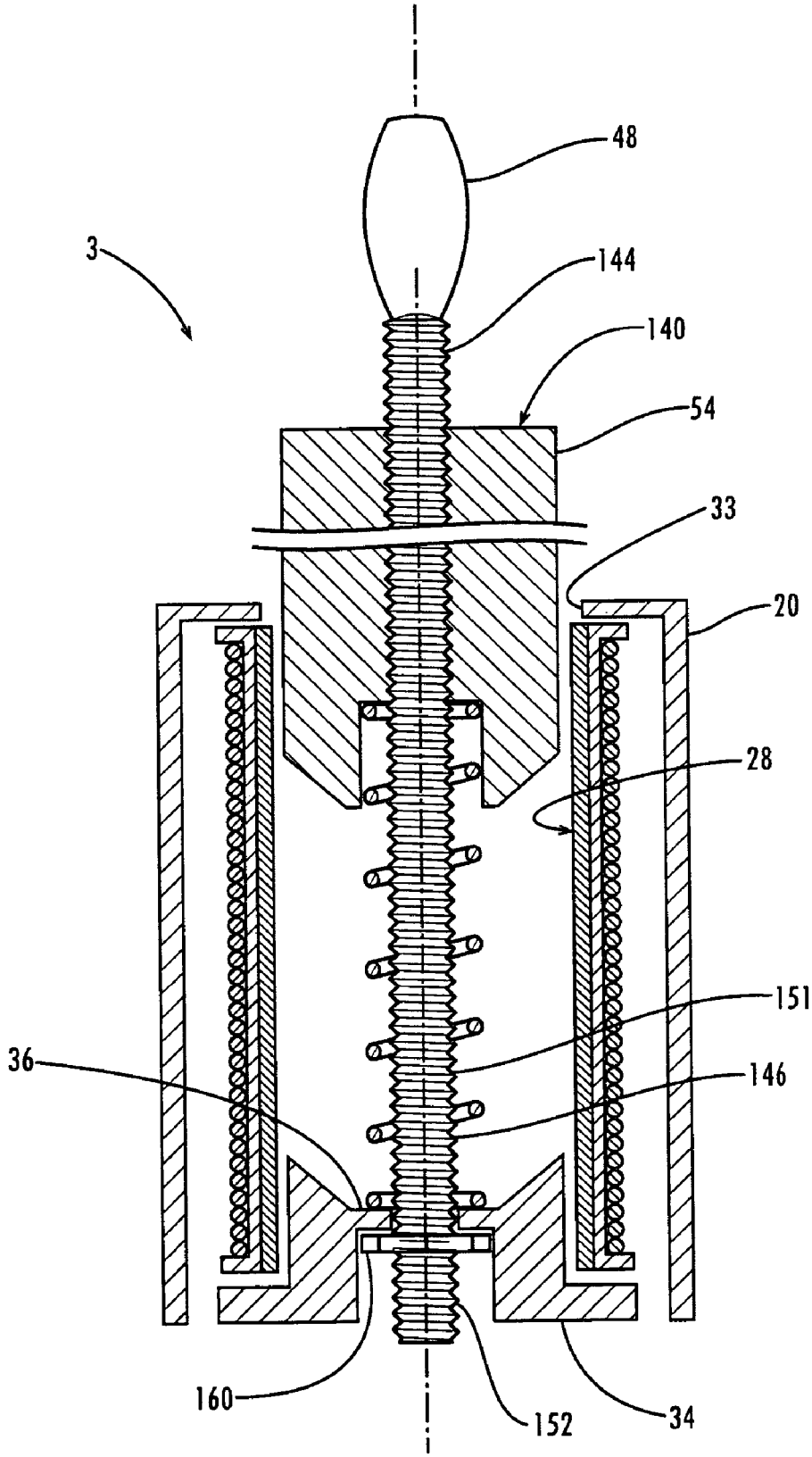
FIG. 5 is a side cross-sectional view of an adjustable solenoid actuator in an un-energized state, in accordance with another embodiment of the present invention.

FIG. 5 is a side cross-sectional view of a pull-type adjustable solenoid actuator 3 in an un-energized state, in accordance with another embodiment of the present invention. The pull-type adjustable solenoid actuator 3 provides the ability to adjust not only the stroke, and therefore the force, but also the relative position of the head with respect to the back stop. In other words, the distance that the plunger extends from the plunger bore is adjustable.

The pull-type adjustable solenoid actuator 3 comprises the same solenoid 20 as the embodiment of FIG. 2. Essentially, the stem 44 of the plunger 40 and the means for retaining engagement of the plunger 40 with the solenoid 20 is changed. The pull-type adjustable solenoid actuator 3 comprises a plunger 140 including an armature 54 and a stem 144. The stem 144 includes a tail 146, at least a portion of which includes a tail threaded portion 152 which includes helical threads 151. The plunger 144 further comprises a fastener 160 adapted for threadable engagement with the tail threaded portion 152. The location of the fastener 160 on the tail threaded portion 152 is adjustable for a particular purpose.

The head 48 extends from the housing aperture 33 a predetermined distance defined by location of the fastener 160 along the stem 144. The plunger 140 is held within the plunger bore 28 by the capturing of the back stop inner flange 36 between the armature 54 and the fastener 160.

The stroke, and therefore the force, is adjustable in substantially the same way as provided for the solenoid actuator 2 of FIG. 2, by the rotation of the stem 144 relative to the armature 54 while retaining the fastener 160 in substantially the same location relative to the stem 144. The head 48 remains in the same relative position with respect to the back stop 34 for any position of the armature 54 along the stem 144.

Alternatively, the position of the head 48 is adjustable relative to the back stop 34 while the stroke, and therefore the force, remains the same. The position of the head 48 relative to the back stop 34 is adjusted by advancing the fastener 160 either towards or away from the head 48. Advancing the fastener 160 towards the head 48 will draw the plunger 140 further into the plunger bore 28 and move the head 48 closer to the back stop 34. Advancing the fastener 160 towards the head 48 a predetermined distance and advancing the armature 54 on the stem 144 the same predetermined distance towards the head 48, effectively retains the same relative position of the armature 54 with respect to the back stop 34, resulting in reducing the distance between the head 48 and the back stop 34 while retaining the same stroke and force.

Alternatively, the position of the head 48 is adjustable relative to the back stop 34 while the stroke, and therefore the force, is also adjustable. The position of the head 48 relative to the back stop 34 is adjusted by advancing the fastener 160 either towards or away from the head 48. Advancing the fastener 160 on the stem a predetermined distance and advancing the armature 54 on the stem 144 a different predetermined distance results in a combination of adjusted head position, stroke and force.

Embodiments shown in FIGS. 2-5 in accordance with the present invention provide adjustable pull-type solenoid actuators by way of having the ability to move the armature with respect to the stem providing a degree of adjustability with regards to the length of stroke. Further, embodiments in accordance with the present invention provide pull-type solenoid actuators with an adjustable-position head by way of having the ability to move the fastener and the armature with respect to the stem providing a constant length of stroke and force. Further, embodiments in accordance with the present invention provide pull-type solenoid actuators with an adjustable stroke, force and head position by way of having the ability to independently move the fastener and the armature with respect to the stem.

FIGS. 2-5 are embodiments of pull-type solenoid actuators. It is appreciated that the features of adjustable stroke and adjustable force can be applied to a push-type solenoid, as well as other types of solenoids, such as, but not limited to, hold-type and rotary-type.

Figure 6:
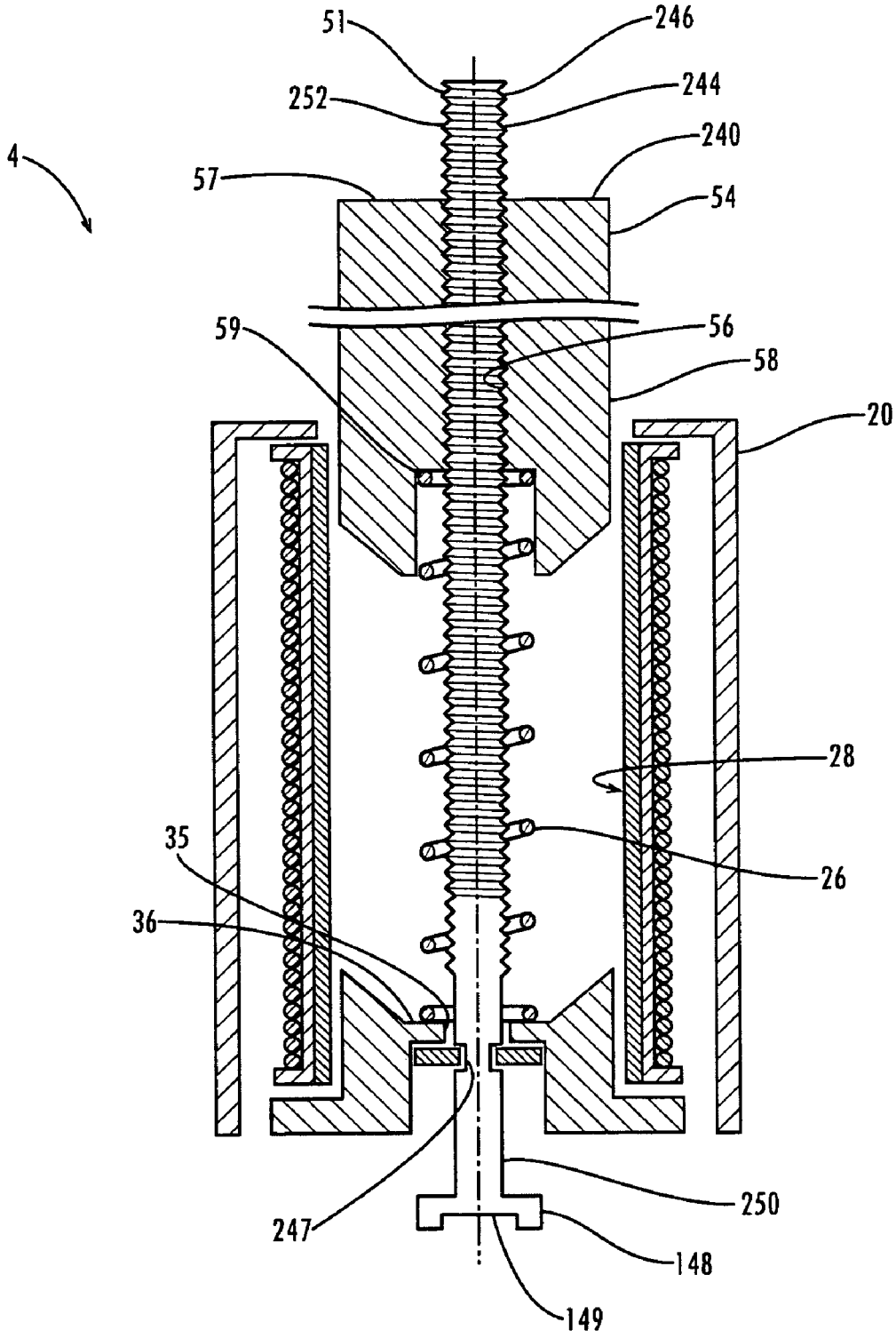
FIG. 6 is a side cross-sectional view of a push-type adjustable solenoid actuator in an un-energized state, in accordance with an embodiment of the present invention.
Figure 1:
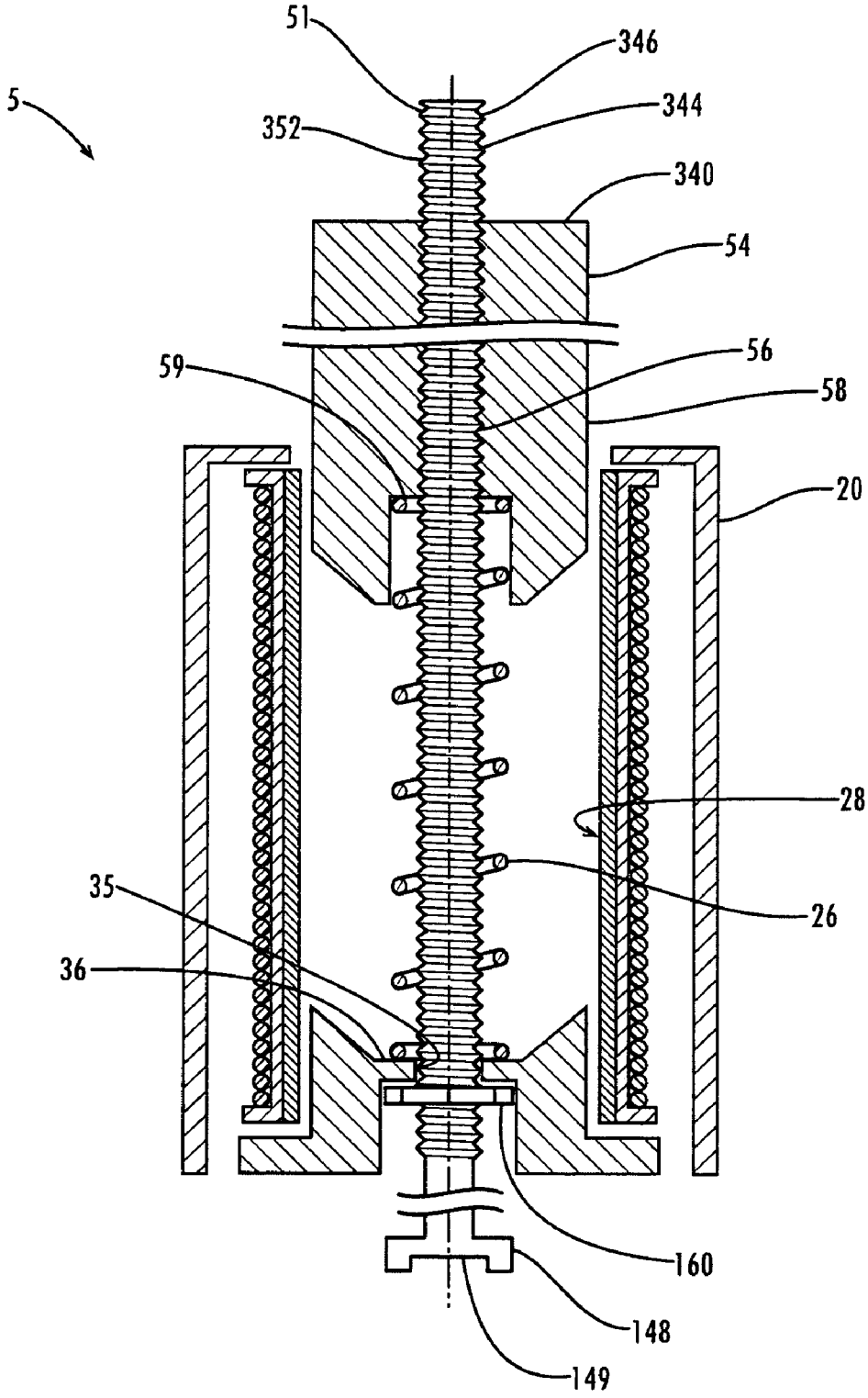

FIG. 6 is a side cross-sectional view of a push-type adjustable solenoid actuator 4 in an un-energized state, in accordance with an embodiment of the present invention. Referring also to FIG. 2, the push-type solenoid actuator 4 comprises the same solenoid 20 as the embodiment of FIG. 2. Essentially, the stem 44 of the plunger 40 is changed. The push-type solenoid actuator 4 comprises a solenoid 20 and a push-type plunger 240. The push-type plunger 220 comprises an armature 54 and a push-stem 244. The push-stem 244 comprises a head 148, a tail 246 opposite the head 148, and a body 250 therebetween. The head 148 comprises at least one plunger coupler element 149. The plunger coupler element 149 is adapted to couple with a mechanism to be activated by the solenoid actuator 4, such as, but not limited to, a valve. It is understood that the plunger coupler element 149 can take many forms suitable for a particular purpose.

The tail 246 is an elongated member having a tail threaded portion 252 which includes helical threads 51. The body 250 includes a stem retention element 247 which is discussed further below.

During assembly of the push-type plunger 240, the tail 246 is passed through the back stop aperture 35, through the spring 26 disposed within the plunger bore 28 between the back stop inner flange 36 and the spring seat 59 of the armature 54, and threadably engaged with the armature bore 56 of the armature 54 from the armature second end 58 to extend from the armature first end 57. The armature 54 is at least partially disposed within the plunger bore 28. The head 148 extends from the plunger bore 28 and through the back stop aperture 35 a predetermined distance defined by location of the stem retention element 247 along the push-stem 244. At least a portion of the body 250 including the stem retention element 247 extends from the plunger bore 28 and through the back stop aperture 35 defined by the back stop inner flange 36. The back stop aperture 35 is adapted to freely receive the tail 46 and body 250 therethrough. The push-type plunger 240 is held within the solenoid 20 by the engagement of a fastener 60 coupled to the body 250 about the stem retention element 247. The fastener 60 has a dimension larger than the dimension of the back stop aperture 35. The fastener 60 is adapted to capture the back stop inner flange 36 between the armature 54 and the fastener 60.

The stroke, and therefore the force, is adjustable in substantially the same way as provided for the solenoid actuator 2 of FIG. 2, by the rotation of the push-stem 244 relative to the armature 54. The head 148 remains in the same relative position with respect to the back stop 34 at any position of the armature 54. When the solenoid 20 is electrically energized, the armature 54 is moved proximate the back stop 34 with the head 148 extending further away from the back stop 34 in a pushing mode.

The push-type adjustable solenoid actuator 4 provides a number of adjustable configurations suitable for a particular purpose. The stroke, and therefore the force, can be adjusted as provided in the embodiment of FIG. 2 providing a head 148 that remains in the same relative position regardless of the position of the armature 54 when the solenoid 20 is un-energized.

FIG. 7 is a side cross-sectional view of a push-type adjustable solenoid actuator 5 in an un-energized state, in accordance with an embodiment of the present invention. The push-type adjustable solenoid actuator 5 further provides the ability to adjust not only the stroke, and therefore the force, but also the relative position of the head with respect to the back stop. In other words, the distance that the plunger extends from the plunger bore is adjustable.

The push-type adjustable solenoid actuator 5 comprises substantially the same solenoid 20 as the push-type adjustable solenoid actuator 4 of FIG. 6. Essentially, the stem 244 of the plunger 240 and the means for retaining engagement of the plunger 240 with the solenoid 20 is changed. The push-type adjustable solenoid actuator 5 comprises a solenoid 20 and a push-type plunger 340. The push-type plunger 340 comprises a push-stem 344 comprising a head 148 and a tail 346 opposite the head 148. The head 148 comprises at least one plunger coupler element 149. The plunger coupler element 149 is adapted to couple with a mechanism to be activated by the solenoid actuator 5, such as, but not limited to, a valve. It is understood that the plunger coupler element 149 can take many forms suitable for a particular purpose.

The tail 346 is an elongated member having a tail threaded portion 352 which includes helical threads 51. The plunger 344 further comprises a fastener 160 adapted for threadable engagement on the tail threaded portion 352. The location of the fastener 160 on the tail threaded portion 352 is adjustable for a particular purpose.

During assembly of the plunger 340, the fastener 160 is advanced in threadable engagement on the tail threaded portion 352 a predetermined distance. The tail 346 is passed through the back stop aperture 35, through the spring 26 that is disposed within the plunger bore 28 between the back stop inner flange 36 and the spring seat 59 of the armature 54, and threadably engaged with the armature bore 56 of the armature 54 from the armature second end 58. The armature 54 is at least partially disposed within the plunger bore 28. The head 148 and at least a portion of the tail threaded portion 352 extends from the back stop aperture 35 a predetermined distance defined by location of the fastener 160 along the stem 344. The plunger 340 is held within the solenoid 20 by the capturing of the back stop inner flange 36 between the armature 54 and the fastener 160.

The stroke, and therefore the force, is adjustable in substantially the same way as provided for the solenoid actuator 4 of FIG. 6, by the rotation of the stem 344 relative to the armature 54 while retaining the fastener 160 in substantially the same location relative to the push-stem 344. The head 148 remains in the same relative position with respect to the back stop 34 for any position of the armature 54. When the solenoid 20 is electrically energized, the armature 54 is moved proximate the back stop 34, as the head 148 extends further away from the back stop 34 in a pushing mode.

Alternatively, the position of the head 148 is adjustable relative to the back stop 34 while the stroke, and therefore the force, remains the same. The position of the head 148 relative to the back stop 34 is adjusted by advancing the fastener 160 either towards or away from the head 148. Advancing the fastener 160 away from the head 148 will draw the plunger 340 further into the plunger bore 28 and move the head 148 farther from the back stop 34. Advancing the fastener 160 away from the head 148 a predetermined distance and advancing the armature 54 on the stem 144 the same predetermined distance away from the head 148, effectively retains the same relative position of the armature 54 with respect to the back stop 34, resulting in increasing the distance between the head 148 and the back stop 34 while retaining the same stroke and force.

Alternatively, the position of the head 148 is adjustable relative to the back stop 34 while the stroke, and therefore the force, is also adjustable. The position of the head 148 relative to the back stop 34 is adjusted by advancing the fastener 160 either towards or away from the head 148. Advancing the fastener 160 on the stem 344 a predetermined distance and advancing the armature 54 on the stem 344 a different predetermined distance results in a combination of adjusted head position, stroke and force.

Embodiments shown in FIGS. 6 and 7 in accordance with the present invention provide push-type solenoid actuators providing a degree of adjustability with regards to the length of stroke and initial force by way of having the ability to move the armature with respect to the stem. Further, embodiments in accordance with the present invention provide push-type solenoid actuators with an adjustable-position head by way of having the ability to move the fastener and the armature with respect to the stem providing a constant length of stroke and force. Further, embodiments in accordance with the present invention provide push-type solenoid actuators with an adjustable stroke, force and head position by way of having the ability to independently move the fastener and the armature with respect to the stem.

For the manufacturer or supplier, a push-type solenoid actuator with the ability to independently adjust a combination of head position and stroke can replace a number of individual fixed-force, fixed-stroke, and fixed head-position solenoid actuators over a predetermined range of stroke, head positions, and rated forces reducing the burden of production and inventory. Further, the adjustable -stroke, -head position, and -rated force solenoid actuator 5 is able to provide the stroke, head positions, and rated forces that are between production models or not currently being manufactured due to economic realities. The adjustable -stroke, -head position, and -rated force solenoid actuators 5 provided in accordance with embodiments of the present invention provides infinite adjustably over the predetermined range. This enables the user to adjust the solenoid actuator 5 to more closely match the application for which it is being used; essentially providing a custom solenoid actuator.

Figure 8:
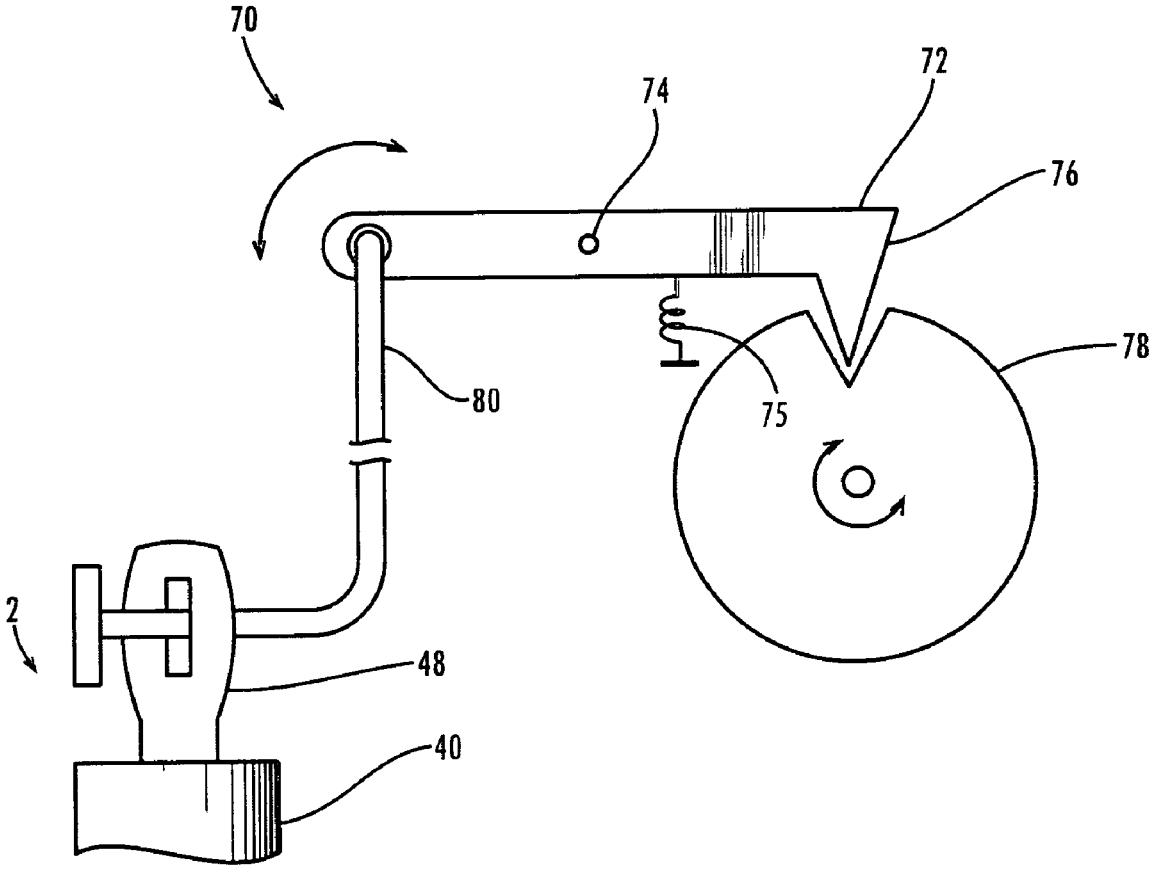
FIG. 8 is a side view of a latching mechanism coupled to a solenoid plunger by a cable in accordance with an embodiment of the present invention.

FIG. 8 is a side view of a latching mechanism coupled to a plunger 40 by a cable 80, shown here as a partial plunger 40 of a solenoid actuator 2 of FIG. 2, in accordance with an embodiment of the present invention. The latching mechanism 70 comprises a lever 72, a pivot 74, a lever head 76, a restoring spring 75, and a locking notch device 78. The plunger 40 comprises a head 48 including a plunger coupler element 49 in the form of an eyelet. The cable 80 is strung through and coupled to the plunger coupler element 49. The head 48 of the plunger 40 of the solenoid actuator 2 pulls the cable 80 that is coupled to the lever 72 to disengage the lever head 76 from the locking-notch device 78. Examples of latching mechanisms 70 include, but are not limited to, vehicle trunk lid latches, hood latches, and door latches. The solenoid actuator 2 provides remote operation of the respective latching mechanism 70. The solenoid actuator 2 is electrically energized by activating an electrical switch (not shown), such as a switch mounted in the cabin, or a button on a hand-held remote control transmitter, for example Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiment shown and described without departing from the scope of the present invention. Those with skill in the art will readily appreciate that the present invention may be implemented in a very wide variety of embodiments. This application is intended to cover any adaptations or variations of the embodiments discussed herein. Therefore, it is manifestly intended that this invention be limited only by the claims and the equivalents thereof.

Persons skilled in the art will recognize that many modifications and variations are possible in the details, materials, and arrangements of the parts and actions which have been described and illustrated in order to explain the nature of this invention and that such modifications and variations do not depart from the spirit and scope of the teachings and claims contained therein.

What is claimed:

1. A solenoid actuator comprising:

a solenoid defining a plunger bore; and a plunger comprising a stem and an armature, the armature including an axial armature bore, the stem engaged with the armature bore and adapted for advancement of the armature along at least a portion of the stem, the plunger comprising a plunger first end and a plunger second end, the stem comprising a head, a tail opposite the head, and a body therebetween, the body comprising an elongated member having a stem threaded portion, the tail including a tail retention element, the armature comprising a cylindrical member adapted for sliding reception within the plunger bore, the armature comprising an armature first end and an armature second end opposite the armature first end, the armature comprising a material highly permeable to a magnetic field, wherein the solenoid comprises:

a coil including a long insulated wire wound with a helical pattern defining the plunger bore about an axis;

a housing defining a cavity adapted to house the coil, the housing including a housing first end and a housing second end opposite the housing first end, the housing first end comprising an inwardly extending coil retention flange defining a housing aperture substantially coaxial with the plunger bore;

a back stop disposed in and adapted to enclose the housing second end and retain the coil within the housing, the back stop comprising a back stop outer flange, a back stop inner flange, and a back stop seat, the back stop outer flange adapted to be slidingly received within the cavity and couple with the housing second end, the back stop inner flange defining a back stop aperture substantially coaxial with the plunger bore, the back stop seat adapted to extend into the plunger bore; and a spring comprising a wire formed into a helical configuration, wherein the armature second end further comprises a spring seat adjacent the armature bore, the spring seat adapted to accept an end of the spring, the plunger second end extending into the plunger bore through the housing aperture, the plunger first end extending out of the plunger bore through the housing aperture, the spring disposed within the plunger bore between the back stop inner flange and the spring seat of the armature, the back stop adapted to prevent the armature from passing through the housing second end, the back stop adapted to allow the tail to pass through the housing second end, the spring adapted to provide an urging bias acting to urge the armature away from the back stop, the plunger disposed within the plunger bore with at least a portion of the tail including the tail retention element extending from the plunger bore and through the back stop aperture, the plunger retained in engagement with the solenoid by the engagement of a fastener coupled to the tail retention element, the fastener adapted to capture the back stop inner flange between the armature and the fastener.

2. A solenoid actuator of claim 1, the housing comprising a material having a high magnetic permeability.

3. A solenoid actuator of claim 1 wherein the back stop comprises a material having a high magnetic permeability.

4. The solenoid actuator of claim 1, the armature second end comprising an armature seat having complementary geometry with the back stop seat.

5. The solenoid actuator of claim 4, the spring seat adapted to contain the spring when compressed by the armature and the back stop to allow for abutment of the backstop seat and the armature seat.

6. The solenoid actuator of claim 1, wherein the plunger bore comprises an axially-aligned keyway, the armature comprises a mating key complimentary to the keyway, the cooperation of the keyway and the key adapted for axial motion of the plunger while restricting rotation of the armature.

7. The solenoid actuator of claim 1, the tail retention element comprising a tail threaded portion, the fastener adapted for threadable engagement with the tail threaded portion, the location of the fastener on the tail threaded portion being adjustable, the head extending from the housing aperture a predetermined distance defined by location of the fastener along the tail threaded portion.

8. A solenoid actuator of claim 7, wherein the armature bore comprises threads, the stem threadably engaged with the armature bore and adapted for advancement of the armature along at least a portion of the stem.

9. The solenoid actuator of claim 7, the tail retention element comprising a tail threaded portion, the fastener adapted for threadable engagement with the tail threaded portion, the location of the fastener on the tail threaded portion being adjustable, the head extending from the housing aperture a predetermined distance defined by location of the fastener along the tail threaded portion.

10. A solenoid actuator of claim 9, wherein the armature bore comprises threads, the stem threadably engaged with the armature bore and adapted for advancement of the armature along at least a portion of the stem.

11. A solenoid actuator of claim 1, wherein the armature bore comprises threads, the stem threadably engaged with the armature bore and adapted for advancement of the armature along at least a portion of the stem.

12. A solenoid actuator comprising:

a solenoid defining a plunger bore; and a plunger comprising a stem and an armature, the armature including an axial armature bore, the stem engaged with the armature bore and adapted for advancement of the armature along at least a portion of the stem, wherein the stem comprises a head, a tail opposite the head, and a body therebetween, the head comprising at least one plunger coupler element, the tail comprising an elongated member having a tail threaded portion, the body including a stem retention element, the solenoid comprising:

a coil including a long insulated wire wound with a helical pattern defining the plunger bore about an axis;

a housing defining a cavity adapted to house the coil, the housing including a housing first end and a housing second end opposite the housing first end, the housing first end comprising an inwardly extending coil retention flange defining a housing aperture substantially coaxial with the plunger bore;

a back stop disposed in and adapted to enclose the housing second end and retain the coil within the housing, the back stop comprising a back stop outer flange, a back stop inner flange, and a back stop seat, the back stop outer flange adapted to be slidingly received within the cavity and couple with the housing second end, the back stop inner flange defining a back stop aperture substantially coaxial with the plunger bore, the back stop seat adapted to extend into the plunger bore; and a spring comprising a wire formed into a helical configuration, wherein the armature second end further comprises a spring seat adjacent the armature bore, the spring seat adapted to accept an end of the spring, the spring disposed within the plunger bore between the back stop inner flange and the spring seat, the tail disposed through the back stop aperture and through the spring and threadably engaged with the armature bore of the armature, the tail extending from the armature first end, the armature at least partially disposed within the plunger bore, the head extending from the plunger bore through the back stop aperture a predetermined distance defined by the location of the stem retention element along the stem, at least a portion of the body including the stem retention element extending from the plunger bore and through the back stop aperture defined by the back stop inner flange, the back stop aperture adapted to receive the tail and body therethrough, the plunger engaged with the solenoid by the engagement of a fastener coupled to the body about the stem retention element, the fastener adapted to capture the back stop inner flange between the armature and the fastener.

13. A solenoid actuator of claim 12, wherein the armature bore comprises threads, the stem threadably engaged with the armature bore and adapted for advancement of the armature along at least a portion of the stem.

14. A solenoid-actuated latching mechanism, comprising:

a latching mechanism comprising a lever, a pivot, a lever head, a restoring spring, a locking notch device, and a cable, the lever adapted to pivot about the pivot, the restoring spring coupled to the lever in urging engagement, the leaver head adapted for engagement with the locking notch device, the cable coupled to the lever; and a solenoid actuator comprising:

a solenoid defining a plunger bore; and a plunger comprising a stem and an armature, the armature including an axial armature bore, the stem engaged with the armature bore and adapted for advancement of the armature along at least a portion of the stem, the plunger comprising a plunger first end and a plunger second end, the stem comprising a head, a tail opposite the head, and a body therebetween, the body comprising an elongated member having a stem threaded portion, the tail including a tail retention element, the armature comprising a cylindrical member adapted for sliding reception within the plunger bore, the armature comprising an armature first end and an armature second end opposite the armature first end, the armature comprising a material highly permeable to a magnetic field, wherein the solenoid comprises:

a coil including a long insulated wire wound with a helical pattern defining the plunger bore about an axis;

a housing defining a cavity adapted to house the coil, the housing including a housing first end and a housing second end opposite the housing first end, the housing first end comprising an inwardly extending coil retention flange defining a housing aperture substantially coaxial with the plunger bore;

a back stop disposed in and adapted to enclose the housing second end and retain the coil within the housing, the back stop comprising a back stop outer flange, a back stop inner flange, and a back stop seat, the back stop outer flange adapted to be slidingly received within the cavity and couple with the housing second end, the back stop inner flange defining a back stop aperture substantially coaxial with the plunger bore; the back stop seat adapted to extend into the plunger bore; and a spring comprising a wire formed into a helical configuration, wherein the armature second end further comprises a spring seat adjacent the armature bore, the spring seat adapted to accept an end of the spring, the plunger second end extending into the plunger bore through the housing aperture, the plunger first end extending out of the plunger bore through the housing aperture, the spring disposed within the plunger bore between the back stop inner flange and the spring seat of the armature, the back stop adapted to prevent the armature from passing through the housing second end, the back stop adapted to allow the tail to pass through the housing second end, the spring adapted to provide an urging bias acting to urge the armature away from the back stop, the plunger disposed within the plunger bore with at least a portion of the tail including the tail retention element extending from the plunger bore and through the back stop aperture, the plunger retained in engagement with the solenoid by the engagement of a fastener coupled to the tail retention element, the fastener adapted to capture the back stop inner flange between the armature and the fastener, the cable coupled to the head, the plunger adapted to pull the cable to disengage the lever head from the locking-notch device, the return spring adapted to urge the lever head into engagement with the locking-notch device.

* * * * *